US007891958B2

(12) United States Patent
Sakai et al.

(10) Patent No.: US 7,891,958 B2
(45) Date of Patent: Feb. 22, 2011

(54) IMPELLER PUMP WITH REFLUX PASSAGES AND APPARATUS USING SAME

(75) Inventors: Toshisuke Sakai, Onojo (JP); Hidetoshi Ueda, Onojo (JP)

(73) Assignee: Panasonic Electric Works Co., Ltd., Osaka (JP)

( * ) Notice: Subject to any disclaimer, the term of this patent is extended or adjusted under 35 U.S.C. 154(b) by 985 days.

(21) Appl. No.: 11/783,771

(22) Filed: Apr. 12, 2007

(65) Prior Publication Data

US 2007/0243086 A1 Oct. 18, 2007

(30) Foreign Application Priority Data

Apr. 18, 2006 (JP) ..... 2006-114528

(51) Int. Cl.
*F04B 39/06* (2006.01)

(52) U.S. Cl. ..... 417/370; 417/423.13

(58) Field of Classification Search ..... 417/370, 417/369, 423.13
See application file for complete search history.

(56) References Cited

U.S. PATENT DOCUMENTS 3,220,349 A * 11/1965 White ..... 417/357
4,225,292 A * 9/1980 Hallerback et al. ..... 417/367
4,644,202 A * 2/1987 Kroy et al. ..... 310/58
5,144,177 A * 9/1992 Rupprecht ..... 310/86
5,997,261 A * 12/1999 Kershaw et al. ..... 417/366

FOREIGN PATENT DOCUMENTS

JP 11-82357 3/1999

* cited by examiner

*Primary Examiner*—Charles G Freay
(74) *Attorney, Agent, or Firm*—Bacon & Thomas PLLC

(57) ABSTRACT

A pump includes a pump part provided with an impeller having a plurality of blades for sucking and discharging a liquid; a pump case accommodating the pump part; a rotor installed to the impeller to rotate the impeller; a motor part accommodating a stator disposed around an outer periphery of the rotor to drive the rotor and a driving circuit for controlling the stator; a partition member for isolating the motor part from the pump part to protect the motor part therefrom. The pump further includes a reservoir space disposed in the impeller; an extra passage provided between the rotor and the partition member and connected to the reservoir space to introduce the liquid thereto from the blades; and one or more reflux passages, formed at the impeller, for flowing the liquid in the reservoir space back to the blades.

10 Claims, 3 Drawing Sheets

IMPELLER PUMP WITH REFLUX PASSAGES AND APPARATUS USING SAME

FIELD OF THE INVENTION

The present invention relates to a pump driven by a motor to suck and discharge a liquid, and a liquid supply apparatus having same.

BACKGROUND OF THE INVENTION

Generally, a pump includes a motor part having a stator generating a magnetic field and a controller controlling the stator; a pump part having an impeller driven by the magnetic field generated by the stator to suck and discharge a liquid such as water; and a partition member isolating the motor part from the pump part.

The pump part increases the pressure of the sucked liquid to discharge same by the impeller. In case of a centrifugal pump, the impeller has a plurality of blades fixed thereto, the whole body of each blade being curved backward with respect to a rotational direction to reduce loads applied thereto.

Since, however, the pressure in the centrifugal pump is increased by a centrifugal force, the rotational speed needs to be increased in order to discharge the liquid with a higher pressure by using a small pump. For this reason, when a gas-laden liquid is sucked, there occurs a problem that the liquid and the gas are separated by the strong centrifugal force applied thereto, and the gas having a smaller specific gravity than the liquid stagnates around a central part of the impeller, thereby decreasing the performance of the pump.

To solve the problem, a pump having a guide member projecting from a pump case towards the impeller has been proposed (see, for example, Japanese Patent Laid-open Application No. 2001-234894).

By employing such a pump case, the gas bubbles ladened in the liquid are disaggregated by the portion of the guide member disposed at a central part of the impeller and discharged through a discharge port, thereby preventing the gas from stagnating in the impeller.

However, if a pumping rate is small and the gas is admixed into the liquid, the flow of the liquid becomes less. In such a case, it is difficult to guide the disaggregated gas bubbles to the discharge port disposed at an outer periphery of the impeller, even with the scheme disclosed in the Patent Application supra.

If a central part of a portion of the liquid discharged by the impeller is fed back into the impeller through a reflux passage for example, it may be possible to discharge the gas stagnant at the central part of the impeller. However, in an exterior rotor structure in which a stator is installed inside the rotor as in the Patent Application supra, it is not possible to feed a sufficient amount of liquid back into the central part of the impeller, so that it is difficult to discharge the gas continuously introduced by being laden in the liquid.

SUMMARY OF THE INVENTION

It is, therefore, an object of the present invention to provide a pump and a liquid supply apparatus capable of preventing a gas from stagnating in an impeller to thereby effectively discharge the gas and provide a high lift (high pressure pump output) and low flow rate pump output.

In accordance with an embodiment of the present invention, there is provided a pump including a pump part provided with an impeller having a plurality of blades for sucking and discharging a liquid; a pump case accommodating the pump part; a rotor installed to the impeller to rotate the impeller; a motor part accommodating a stator disposed around an outer periphery of the rotor to drive the rotor and a driving circuit for controlling the stator; a partition member for isolating the motor part from the pump part to protect the motor part therefrom. The pump further comprises a reservoir space disposed in the impeller; an extra passage provided between the rotor and the partition member and connected to the reservoir space to introduce the liquid thereto from the blades; and one or more reflux passages, formed at the impeller, for flowing the liquid in the reservoir space back to the blades.

With the pump structure described above, even when the flow rate is small, the liquid fed through the extra passage and stored in the reservoir space can be introduced into the central part of the impeller in a pump chamber with a sufficient flow rate via the reflux passage. As a result, it is possible to efficiently discharge the gas stagnating in the central part of the impeller.

Therefore, in accordance with the present invention, it is possible to provide a pump capable of effectively discharging the gas stagnating in an impeller and providing a high lift and low flow rate pump output.

In addition, it is possible that the reflux passages are disposed adjacent to a bearing provided at the central part of the impeller.

With such a structure, a pressure difference between the reservoir space and the central part of the impeller can be maximized and the liquid stored in the reservoir space can be discharged via the reflux passage into the central part of the impeller where the gas stagnates to disaggregate the gas bubbles.

It is also preferable that the reflux passages are formed at the central part of the impeller at identical angular intervals.

With such a structure, balance of the impeller may be maintained to suppress vibrations of the pump.

In addition, a passage may be preferably formed outside the extra passage at an inner sidewall of the pump case on a substantially same plane as a liquid flow direction of the impeller.

With such a structure, the gas laden in the liquid accelerated together with the liquid by the impeller can be in a laminar flow. Therefore, the flow direction of the gas can remain unchanged up to the inner sidewall of the pump case, so that the gas can be prevented from getting into the extra passage.

It is also preferable that the extra passage is disposed at an angle of 90° or greater with respect to the liquid flow direction of the impeller.

With such a structure, the laminar flow direction of the gas accelerated with the liquid in the impeller is not changed much, even when the flow rate in the extra passage is increased. Therefore, it is possible to prevent the gas getting into the extra passage.

Further, a front shroud may be preferably disposed at an upper surface of the blades facing the pump case to cover the blades.

With such a structure, it is possible to prevent leakage of the gas-ladened liquid guided into the impeller and can be effectively discharged.

Further more, the impeller may have a slide bearing rotating by using the liquid sucked into the pump part as a lubricant.

As a result, the liquid serving as the lubricant between the shaft and the bearing decreases a friction therebetween. Thus, it is possible to suppress wearing of the bearing, thereby increasing a life span of the bearing.

In addition, when the pump is installed in a liquid supply apparatus such as a cooling or the like apparatus, it is possible to improve the performance of the liquid supply apparatus.

BRIEF DESCRIPTION OF THE DRAWINGS

The above and other objects and features of the present invention will become apparent from the following description of embodiments given in conjunction with the accompanying drawings, in which.

DETAILED DESCRIPTION OF THE EMBODIMENTS

Hereinafter, a specific embodiment in accordance with the present invention will be described with reference to the accompanying drawings.

Figure 1:
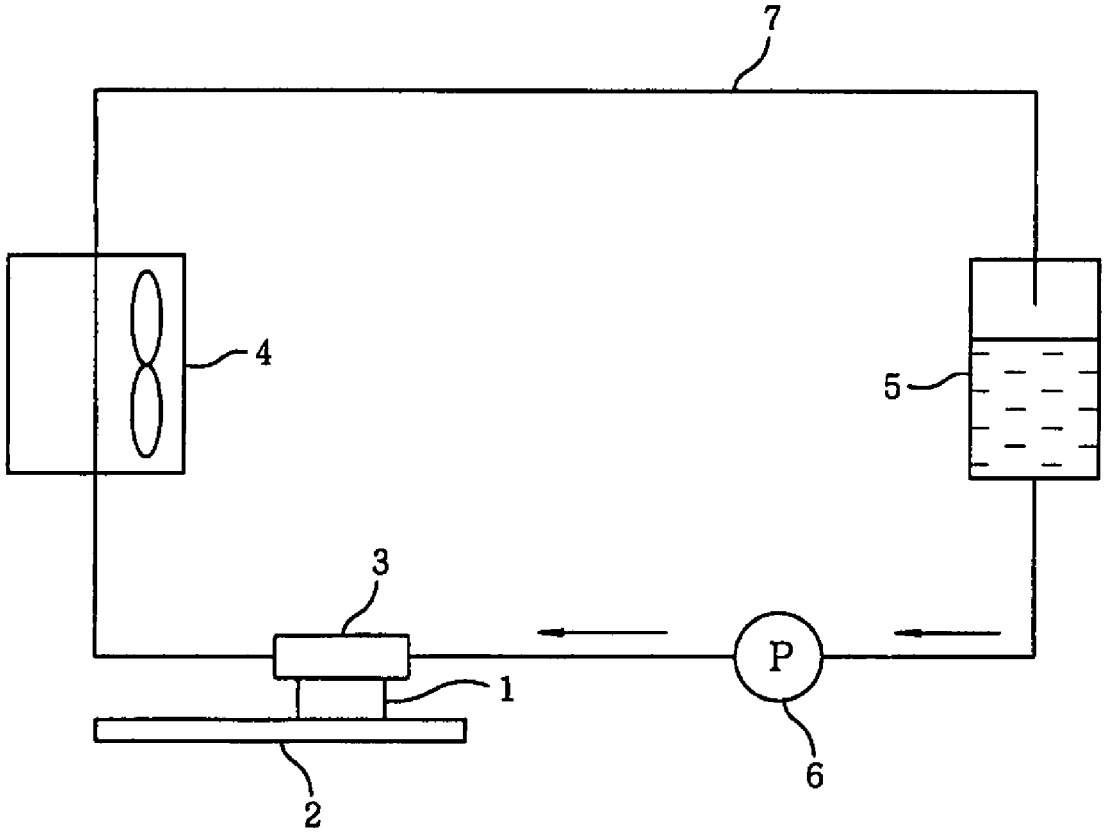
FIG. 1 is a schematic view of a cooling apparatus for an electronic part in accordance with an embodiment of the present invention.

As shown in FIG. 1, a heat generating component 1 is mounted on a substrate 2, and a heat sink 3 is disposed thereon to perform heat exchange with the heat generating component 1 by using a coolant to cool same.

In addition, a heat radiator 4 for removing heat from the coolant, a reservoir tank 5 for storing the coolant, and a small pump 6 for circulating the coolant are disposed. Further, a pipe 7 is provided to connect the heat sink 3, the heat radiator 4, the reservoir tank 5, and the pump 6. The components 3 to 7 constitute a cooling apparatus.

The coolant in the reservoir tank 5 is pumped by the pump 6 to be sent to the heat sink 3 through the pipe 7. Heat of the heat generating component 1 is transferred to the coolant so that the temperature of the coolant increases. The coolant then is sent to the heat radiator 4. As a result, the coolant is cooled in the heat radiator 4 and then returned to the reservoir tank 5. As described above, such a cooling system cools the heat generating component 1 by circulating the coolant using the pump 6.

Figure 2:
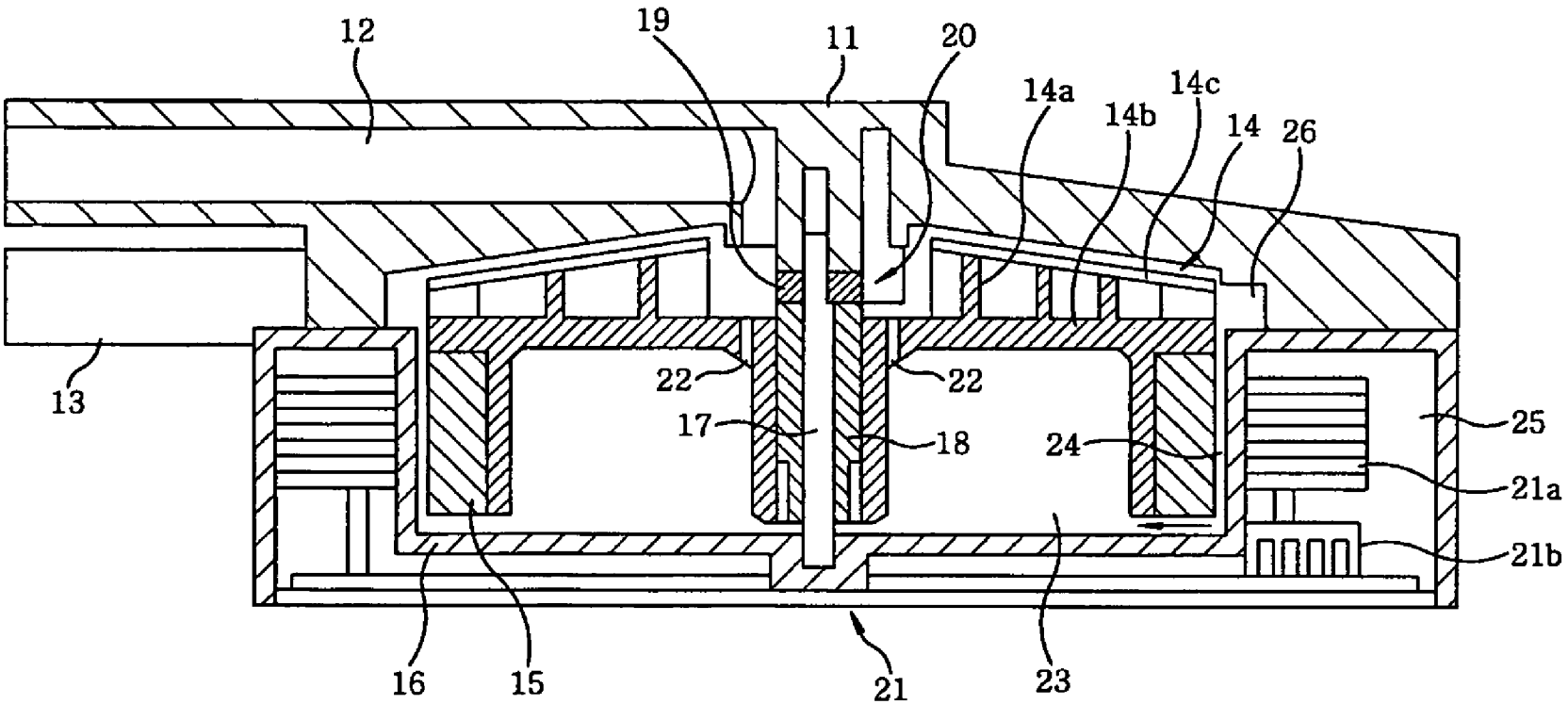
FIG. 2 is a cross-sectional view of a pump in accordance with the embodiment of the present invention.

As shown in FIG. 2, the pump 6 includes a pump case 11, a partition member 16, a pump part 20, and a motor part 21, which is isolated from the pump case 11 and the pump part 20 by the partition member 16. The pump part 20 is disposed in a space sealed by the partition member 16 and the pump case 11 having a suction port 12 and a discharge port 13. The pump part 20 includes an closed type impeller 14 having a rear shroud 14*b*, on which a plurality of blades 14*a* for pressurizing the fluid are disposed from the center of rotation to the outer periphery thereof in a radial direction and a front shroud 14*c* connected to the blades 14*a*. The pump part 20 further includes a rotor magnet (rotor) 15 integrally formed with the impeller 14; a shaft 17 fixed to the pump case 11 and the partition member 16 at its both ends; a bearing 18 fixed to the impeller 14 to rotatably support the shaft 17 and formed of a resin having abrasion resistance and low friction such as PPS (polyphenylene sulfide) resin containing carbon; and a thrust bearing 19 fixed to the pump case 11.

A stator 21*a* constituting the motor part 21 is fixed to an annular recess part 25 of the partition member 16. A driving circuit 21*b* for driving the stator 21*a* is fixed to the stator 21*a*.

In addition, the blades 14*a* of the impeller 14 are fixed to the rear shroud 14*b* to be curved backward with respect to a rotational direction in order to reduce loads of the blades, and a plurality of reflux passages 22 in communication with a rear surface of the impeller 14 are opened around the bearing 18 disposed at equal angular intervals at the central part of the impeller 14. The reflux passages 22 preferably have a diameter of about 0.5 mm to 1.0 mm. If the diameter is too small, the liquid is not supplied into the central part of the impeller 14. If the diameter is too large, the liquid supply into the central part of the impeller 14 is increased, but pressure drop also increases to lower the entire lift of the pump.

At the back side of the impeller 14, there is provided a reservoir space 23 formed of a substantially entire cavity enclosed by an inner periphery of the rotor magnet 15. The liquid is sucked into the reservoir space 23 via an extra passage 24 formed between the rotor magnet 15 disposed at the outer periphery of the impeller 14 and the partition member 16, and the extra passage 24 is connected to the reservoir space 23 through a lower part of the rotor magnet 15. The extra passage 24 has a structure that an inlet opening thereof is narrowest.

Figure 3:
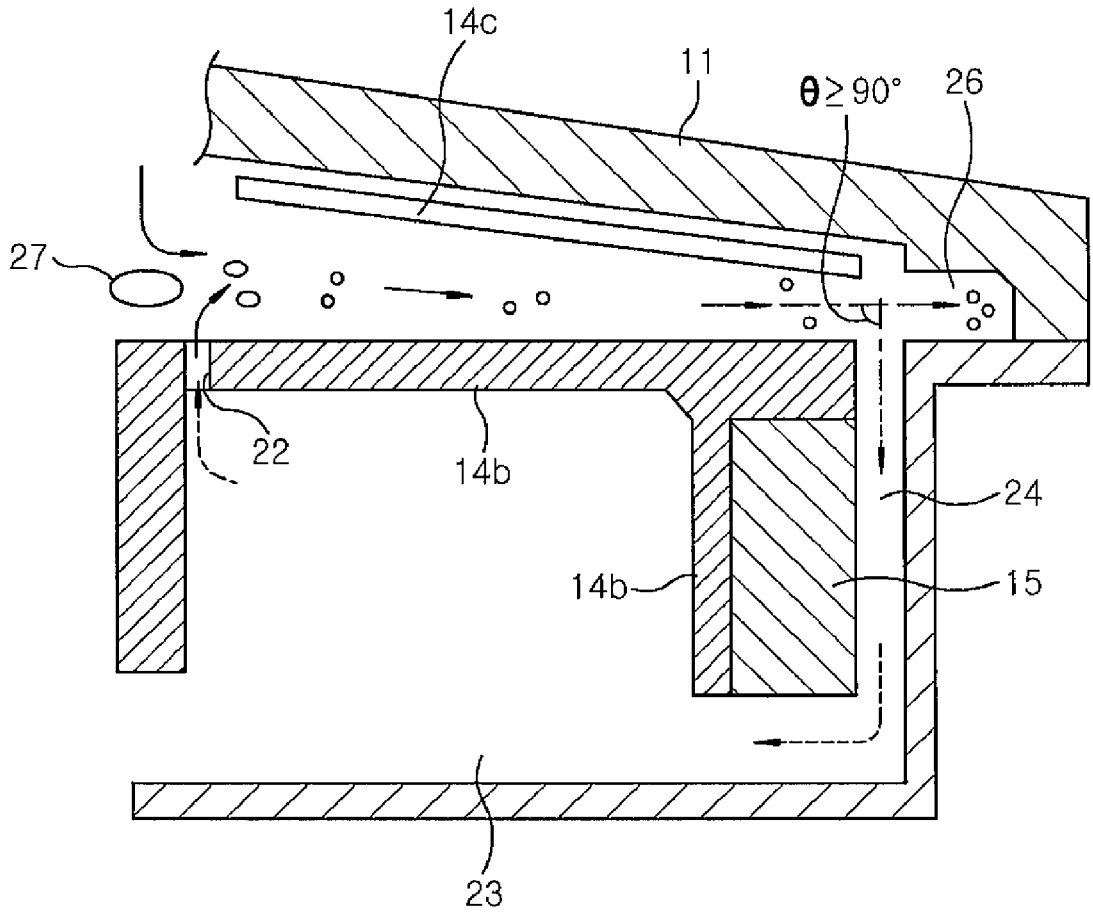
FIG. 3 is an enlarged cross sectional view of an inlet opening of an extra passage of the pump in accordance with the embodiment of the present invention.

Hereinafter, operation of the pump and the cooling apparatus having same in accordance with the embodiment of the present invention will be described with reference to FIGS. 1 to 3.

When an electric power is applied from an external power supply (not shown), currents flow through coils of the stator 21*a* controlled by the driving circuit 21*b* provided in the pump 6 to thereby generate a rotational magnetic field. When the rotational magnetic field is applied to the rotor magnet 15, physical force is applied to the rotor magnet 15. Since the rotor magnet 15 is integrally formed with the impeller 14, a rotational torque is applied to the impeller 14, thereby causing the impeller 14 to rotate to drive the pump 6.

When the pump 6 is driven, rotation of the impeller 14 makes the central part of the impeller 14 brought into a negative pressure, and the coolant in a reservoir tank 5 is sucked into the central part of the impeller 14 together with gas bubbles via the suction port 12.

The sucked coolant is guided along the blades 14*a* toward the outer periphery thereof by a centrifugal force of the impeller 14 while being pressurized. In addition, the gas bubbles having a specific gravity smaller than the coolant are collected at the central part of rotation by the centrifugal force, and the amount of liquid thereat reduces, which causes the gas bubbles to aggregate to become a larger gas mass. In accordance with the embodiment of the present invention, however, the coolant pressurized in the reservoir space 23 is discharged via the reflux passages 22 to the central part of the impeller 14 having the negative pressure. Therefore, the gas bubbles 27 at the central part of the impeller 14 are disaggregated and the coolant flow rate thereat is also increased, thereby allowing the gas bubbles 27 to be guided to the outer periphery of the impeller 14 with the coolant.

A volute passage 26 is formed at an inner sidewall of the pump case 11 on a substantially same plane as a coolant flow direction of the rear shroud 14*b* of the impeller 14. The volute passage 26 is formed to have a gently curved plane around the outer periphery of the impeller 14 and the width thereof (i.e. a distance between the outer periphery of the impeller 14 and that of the volute passage 26) gradually increases towards the discharge port 13. The coolant flows at the outer periphery of the impeller 14 in a laminar fashion along a substantially normal direction to the rotation direction thereof, and the opening of the extra passage 24 is formed to have an angle of Θ (90° or more) with respect to the coolant flow direction. Therefore, the coolant containing the gas bubbles 27 can be guided to the volute passage 26 while preventing the gas bubbles 27 from getting into the extra passage 24. Further, since the volute passage 26 is formed outside the extra passage 24 at the inner sidewall of the pump case 11 on the same plane as the fluid flow direction, the gas bubbles 27 are guided to the outside of the extra passage 24 and prevented from being introduced into the extra passage 24.

The extra passage 24 preferably has an opening width of about 0.2 mm to 0.7 mm. If the inlet opening width is too small, it would be difficult to supply the coolant into the reservoir space 23, and if the opening width is too large, the gas bubbles 27 may be readily introduced thereinto. In addition, in order to reduce pressure loss, the other portion than the opening (e.g., a portion between a lower part of the rotor magnet 15 and the partition member 16) of the extra passage 24 has a larger width. The coolant guided to the volute passage 26 is guided to the discharge port 13 in the pressurized state and discharges the gas bubbles 27.

When the pump 6 is driven to discharge the high pressure coolant from the discharge port 13, the coolant in the reservoir tank 5 is sent to the heat sink 3 through the pipe 7 and heated after being heat-exchanged with the heat generating component 1. The heated coolant is then sent to the heat radiator 4 and cooled after passing therethrough. The cooled coolant is returned to the reservoir tank 5.

As described above, the cooling system of the embodiment is capable of cooling the heat generating component 1 by circulating the coolant using the pump 6. The passage in the heat sink 3 has a high flow resistance in order to increase heat absorption performance.

In accordance with the embodiment, even when the flow rate is low, the liquid stored in the reservoir space 23 through the extra passage 24 is introduced into the impeller 14 through the reflux passages 22. Therefore, it is possible to obtain a sufficient inner flow rate in the pump chamber to thereby efficiently discharge the gas 27 to be otherwise stagnant in the central part of the impeller 14.

In addition, since the coolant is sucked through the central part of the impeller, it is possible to decrease a friction between the bearing 18 and the shaft 17 by the lubrication of the liquid therebetween, thereby lengthening the life span of the pump and providing a high lift pump output.

The pump structure in accordance with the embodiment of the present invention can be applied to various pumps used in a fuel cell apparatus or a cooling apparatus.

While the invention has been shown and described with respect to the preferred embodiments, it will be understood by those skilled in the art that various changes and modifications may be made without departing from and scope of the invention as defined in the following claims.

What is claimed is:

1. A pump comprising:

a pump part including an impeller having a plurality of blades for sucking and discharging a liquid;

a pump case accommodating the pump part;

a rotor installed on the impeller to rotate the impeller;

a motor part accommodating a stator disposed around an outer periphery of the rotor to drive the rotor and a driving circuit for controlling the stator;

a partition member for isolating the motor part from the pump part to protect the motor part therefrom;

a shaft fixed to the pump case and the partition member at both ends thereof;

a reservoir space disposed in the impeller;

an extra passage provided between the rotor and the partition member and connected to the reservoir space to introduce the liquid thereto from the blades; and one or more reflux passages, formed in the impeller, for flowing the liquid in the reservoir space back to the blades, wherein the impeller is rotatably attached to the shaft and rotates around the shaft.

2. The pump according to claim 1, wherein said one or more reflux passages are disposed adjacent to the shaft provided at a central part of the impeller.

3. The pump according to claim 1, wherein the number of the reflux passages are greater than one, and the reflux passages are formed at a central part of the impeller at equal angular intervals.

4. The pump according to claim 1, wherein a passage is formed outside the extra passage at an inner sidewall of the pump case on a substantially same plane as a fluid flow direction of the impeller.

5. The pump according to claim 1, wherein the extra passage is formed such that an angle between a liquid flow direction in the extra passage and a liquid flow direction in the impeller is 90° or greater.

6. The pump according to claim 1, wherein a front shroud is disposed at an upper surface of the blades facing the pump case to cover the blades.

7. The pump according to claim 1, wherein the impeller has a slide bearing rotating by using the liquid sucked into the pump part as a lubricant.

8. An apparatus comprising:

a pipe in which a liquid circulates; and the pump according to claim 1 for circulating the liquid in the pipe.

9. The pump according to claim 1, wherein the number of reflux passages is greater than one.

10. The pump according to claim 4, wherein a width of the passage gradually increases towards a discharge port of the pump case.

* * * * *